US011316295B2

(12) United States Patent
Schafmeister et al.

(10) Patent No.: US 11,316,295 B2
(45) Date of Patent: Apr. 26, 2022

(54) CONNECTOR PART HAVING HERMAPHRODITIC CONTACT ELEMENTS

(71) Applicants: ept Holding GmbH & Co. KG, Peiting (DE); Phoenix Contact GmbH & Co. KG, Blomberg (DE)

(72) Inventors: Arndt Schafmeister, Doerentrup (DE); Ralf Geske, Schieder-Schwalenberg (DE); Georg Brennauer, Wildsteig (DE)

(73) Assignees: EPT HOLDING GMBH & CO. KG, Peiting (DE); PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 17/046,811

(22) PCT Filed: Apr. 12, 2019

(86) PCT No.: PCT/EP2019/059411
§ 371 (c)(1),
(2) Date: Oct. 12, 2020

(87) PCT Pub. No.: WO2019/201768
PCT Pub. Date: Oct. 24, 2019

(65) Prior Publication Data

US 2021/0083416 A1 Mar. 18, 2021

(30) Foreign Application Priority Data

Apr. 17, 2018 (BE) ..... 2018/5256

(51) Int. Cl.
*H01R 13/28* (2006.01)
*H01R 12/71* (2011.01)
(Continued)

(52) U.S. Cl.
CPC ..... *H01R 13/28* (2013.01); *H01R 12/716* (2013.01); *H01R 24/84* (2013.01); *H01R 2107/00* (2013.01)

(58) Field of Classification Search
CPC ..... H01R 13/28; H01R 12/716; H01R 24/84; H01R 2107/00
(Continued)

(56) References Cited

U.S. PATENT DOCUMENTS 3,042,894 A 7/1962 Fox
5,098,311 A * 3/1992 Roath ..... H01R 12/714 439/290
(Continued)

FOREIGN PATENT DOCUMENTS

CN 105122553 A 12/2015
CN 205944656 U 2/2017
(Continued)

*Primary Examiner* — Oscar C Jimenez
(74) *Attorney, Agent, or Firm* — Leydig, Voit & Mayer, Ltd.

(57) ABSTRACT

A connector part includes: a plurality of hermaphroditic contact elements for contacting associated hermaphroditic contact elements of a mating connector part, each of the plurality of hermaphroditic contact elements having a body, a first contact lug extending from the body along a first direction, and a second contact lug extending from the body along the first direction. The first contact lug and the second contact lug are offset from each other along a second direction that extends transversely to the first direction, and along a third direction that extends transversely to the first direction and transversely to the second direction. The connector part has, for each hermaphroditic contact element, a hermaphroditic contact element mirror-inverted to a first mirror plane spanned by the first direction and the third direction and a hermaphroditic contact element mirror-
(Continued)

inverted to a second mirror plane spanned by the first direction and the second direction.

9 Claims, 5 Drawing Sheets

(51) Int. Cl.
*H01R 24/84* (2011.01)
*H01R 107/00* (2006.01)

(58) Field of Classification Search
USPC ..... 439/284
See application file for complete search history.

(56) References Cited

U.S. PATENT DOCUMENTS

| | | | | |
|---|---|---|---|---|
| 6,193,537 | B1 | 2/2001 | Harper, Jr. et al. | |
| 9,362,646 | B2 | 6/2016 | Cohen | |
| 2007/0275586 | A1* | 11/2007 | Ngo ..... | H01R 13/28 439/290 |
| 2008/0194125 | A1 | 8/2008 | Dahms et al. | |
| 2013/0102199 | A1 | 4/2013 | Venaleck et al. | |
| 2013/0316594 | A1 | 11/2013 | Stokoe | |

FOREIGN PATENT DOCUMENTS

| | | | |
|---|---|---|---|
| DE | 2806496 | A1 | 8/1978 |
| EP | 1973201 | B1 | 7/2011 |
| TW | 463750 | B | 12/2014 |

* cited by examiner

CONNECTOR PART HAVING HERMAPHRODITIC CONTACT ELEMENTS

CROSS-REFERENCE TO PRIOR APPLICATIONS

This application is a U.S. National Phase application under 35 U.S.C. § 371 of International Application No. PCT/EP2019/059411, filed on Apr. 12, 2019, and claims benefit to Belgian Patent Application No. BE 2018/5256, filed on Apr. 17, 2018. The International Application was published in German on Oct. 24, 2019 as WO 2019/201768 under PCT Article 21(2).

FIELD

The invention relates to a connector part.

BACKGROUND

Such a connector part comprises a plurality of hermaphroditic contact elements for contacting associated hermaphroditic contact elements of a mating connector part, wherein each hermaphroditic contact element has a body, a first contact lug extending from the body along a first direction, and a second contact lug extending from the body along the first direction. In this case, the first contact lug and the second contact lug are offset relatively to one another along a second direction, which extends transversely to the first direction, and also along a third direction, which extends transversely to the first direction and transversely to the second direction.

Connector parts having hermaphroditic contact elements can be plugged together to create an electrical contact between the contact elements. In this case, the hermaphroditic contact elements of the connector parts are of the same design so that, as is otherwise customary, a connector part is not configured for socket contacts and the other connector part is not configured for pin contacts. Instead, the hermaphroditic contact elements of both connector parts have both socket and pin properties.

Connector parts with hermaphroditic contact elements are known, for example, from U.S. Pat. No. 6,193,537 and EP 1 973 201 B1.

In the known hermaphroditic contact elements of a connector part, contact lugs protrude parallelly to one another from a body and serve to abut against contact lugs of an associated hermaphroditic contact element of the mating connector part from different sides (with respect to the third direction) so that the first contact lug of the hermaphroditic contact element of the connector part interacts in an electrically contacting manner with a second contact lug of an associated hermaphroditic contact element of the mating connector part and the second contact lug of the hermaphroditic contact element of the connector part interacts in an electrically contacting manner with the first contact lug of the associated hermaphroditic contact element of the mating connector part.

If connector parts with such hermaphroditic contact elements are plugged together, torques may occur at the hermaphroditic contact elements, which torques must be absorbed by and deflected from the connector part and the mating connector part. Particularly, in this way, stress that can affect the use-life of the connector part can occur between hermaphroditic contact elements and a printed circuit board on which the hermaphroditic contact elements are arranged.

SUMMARY

In an embodiment, the present invention provides a connector part, comprising: a plurality of hermaphroditic contact elements configured to contact associated hermaphroditic contact elements of a mating connector part, each of the plurality of hermaphroditic contact elements having a body, a first contact lug extending from the body along a first direction, and a second contact lug extending from the body along the first direction, wherein the first contact lug and the second contact lug are offset from each other along a second direction that extends transversely to the first direction, and along a third direction that extends transversely to the first direction and transversely to the second direction, and wherein the connector part has, for each hermaphroditic contact element, a hermaphroditic contact element mirror-inverted to a first mirror plane spanned by the first direction and the third direction and a hermaphroditic contact element mirror-inverted to a second mirror plane spanned by the first direction and the second direction

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
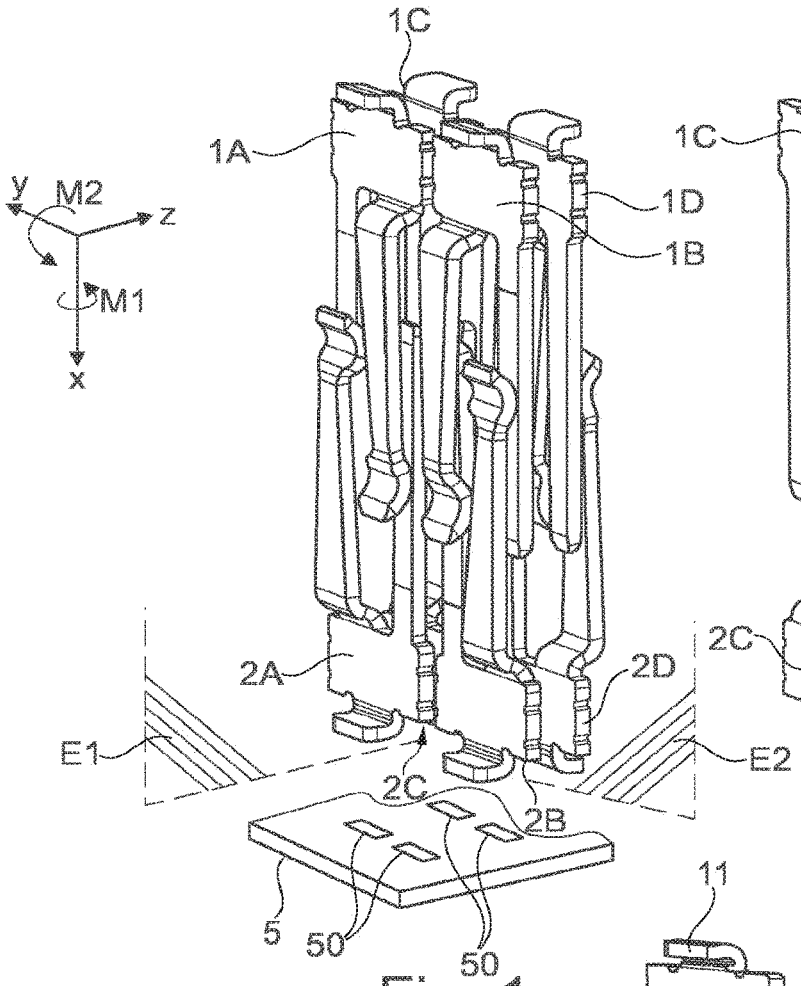
FIG. 1 a view of an arrangement of hermaphroditic contact elements in a connected state.

In an embodiment, the present invention provides a connector part, in which a torque load on the hermaphroditic contact elements can be reduced.

Accordingly, the connector part has, for each hermaphroditic contact element, a hermaphroditic contact element which is mirror-inverted to a first mirror plane and a hermaphroditic contact element which is mirror-inverted to a second mirror plane. In this case, the first mirror plane is spanned by the first direction and the third direction and the second mirror plane is spanned by the first direction and the second direction.

For each hermaphroditic contact element, mirror-inverted hermaphroditic contact elements are thus present, which causes torques to act in a mirror-inverted manner and thus to cancel each other during plug-in connection of the connector part with an associated mating connector part. Because a hermaphroditic contact element mirrored at the first mirror plane (which is spanned by the first direction and the third direction) and a hermaphroditic contact element mirrored at the second mirror plane (which is spanned by the first direction and the second direction) is present for each hermaphroditic contact element, torques that act around the first direction and around the second direction are canceled so that a balanced connector part is provided with a reduced stress by torques during plug-in connection with an associated mating connector part.

Along the first direction extends the contact lug from the body. Along the second direction, the contact lugs are offset from one another on the body and are thus arranged next to one another on the body. Along the third direction, the contact lugs interact in an electrically contacting manner with associated contact lugs of a hermaphroditic contact element of the mating connector part. As a result of using mirror-inverted hermaphroditic contact elements, torques resulting from plug-in connection of the hermaphroditic contact elements of the connector part with associated hermaphroditic contact elements of the mating connector part cancel each other about the first direction and about the second direction so that a torque load between the connector parts is at least reduced during plug-in connection.

Preferably, the number of hermaphroditic contact elements of the connector part corresponds to 4 or an integer multiple of 4, i.e., 8, 12, 16, etc. The arrangement of the hermaphroditic contact elements is mirrored such that for each hermaphroditic contact element, a hermaphroditic contact element mirror-inverted to the first mirror plane and a hermaphroditic contact element mirror-inverted to the second mirror plane exist. The arrangement of the hermaphroditic contact elements is thus balanced so that a torque load is canceled as a result.

In one embodiment, the body extends planarly along a plane spanned by the first direction and the second direction. The hermaphroditic contact element can be manufactured, for example, as a cut and bent part, for example from a metal sheet. Accordingly, the body extends in the plane spanned by the first direction and the second direction.

In this case, the first contact lug can extend in the plane of the body and thus protrudes from the body in the first direction. The first contact lug may have the shape of a contact pin, for example.

In contrast, the second contact lug can be offset from the plane along the third direction and thus protrudes out of the plane. The second contact lug may, for example, be connected to the body via a connecting section, in the region of which a bend is created, so that the second contact lug is offset from the plane and arranged outside the plane.

For each hermaphroditic contact element of the connector part, there is a hermaphroditic contact element which is mirror-inverted to the first mirror plane and a hermaphroditic contact element which is mirror-inverted to the second mirror plane. In this case, it may also be provided that groups of hermaphroditic contact elements are mirrored to one another so that, for a group of more than one hermaphroditic contact element, a group of hermaphroditic contact elements mirror-inverted to the first mirror plane and a group of hermaphroditic contact elements mirror-inverted to the second mirror plane exist. For example, a group of three hermaphroditic contact elements that is mirror-inverted to the first mirror plane and a group of three hermaphroditic contact elements that is mirror-inverted to the second mirror plane can exist in this way for a group of three hermaphroditic contact elements. The torques are thus canceled in groups in that mirror-inverted groups of hermaphroditic contact elements exist for each group of hermaphroditic contact elements.

In one embodiment, the hermaphroditic contact elements are jointly connected to a printed circuit board. The printed circuit board may, for example, extend in a plane spanned by the second direction and the third direction and have connection locations with which the hermaphroditic contact elements are soldered, for example, so that the hermaphroditic contact elements are mechanically fastened to the printed circuit board and are also electrically contacted by the printed circuit board. For this purpose, each hermaphroditic contact element can, for example, have a connection tab which protrudes from the body and which makes possible a soldering connection to the printed circuit board.

A connector system comprises a connector part of the type described above and a mating connector part which has a number of hermaphroditic contact elements corresponding to the number of hermaphroditic contact elements of the connector part and with which the connector part can be connected in a plugged manner. The hermaphroditic contact elements of the connector part and of the mating connector part are designed identically and are arranged relatively to each other in such a way that the hermaphroditic contact elements can be brought into electrical contact with one another by connecting the connector part to the mating connector part in a plugged manner.

Figure 2:
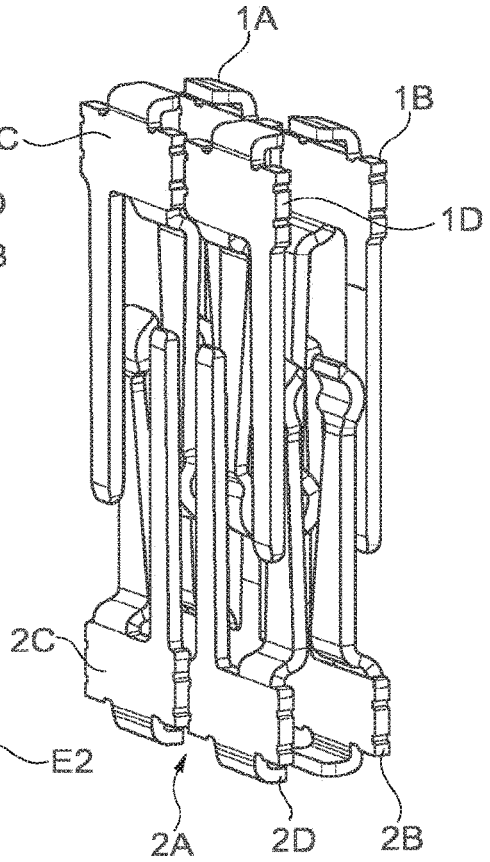
FIG. 2 a view of another arrangement of hermaphroditic contact elements.

FIGS. 1 and 2 show arrangements of hermaphroditic contact elements 1A-1D, 2A-2D, which are part of different connector parts and can be connected to one another in a plugged manner along a direction of insertion along a first direction X in order to create in this way an electrical contact between the hermaphroditic contact elements 1A-1D, 2A-2D.

Figure 3:
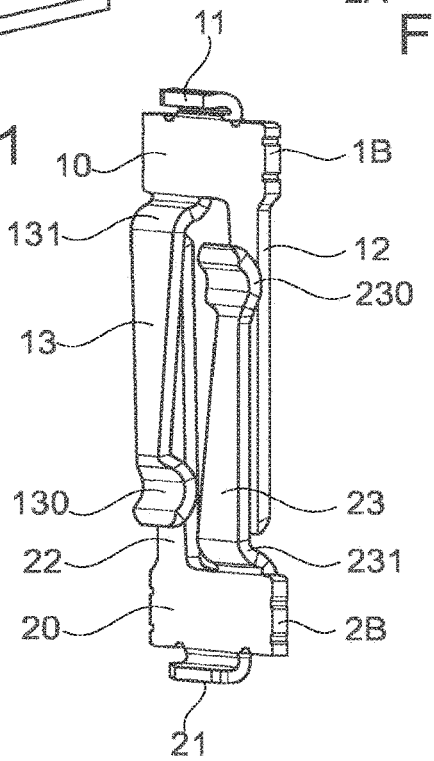
FIG. 3 a view of a hermaphroditic contact element in combination with an associated hermaphroditic contact element.
Figure 4A:
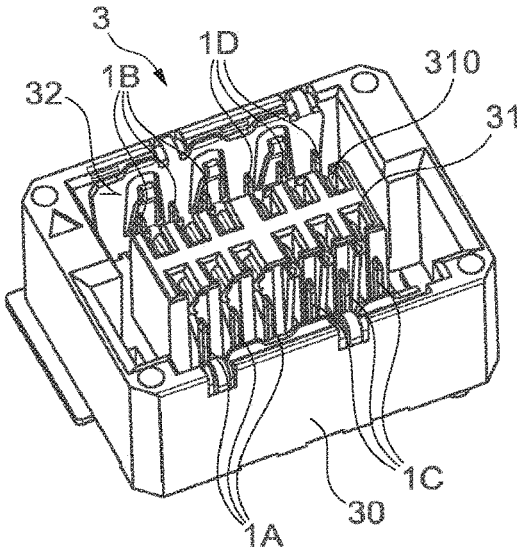
FIG. 4A a view of a connector part having an arrangement of hermaphroditic contact elements.
Figure 4B:
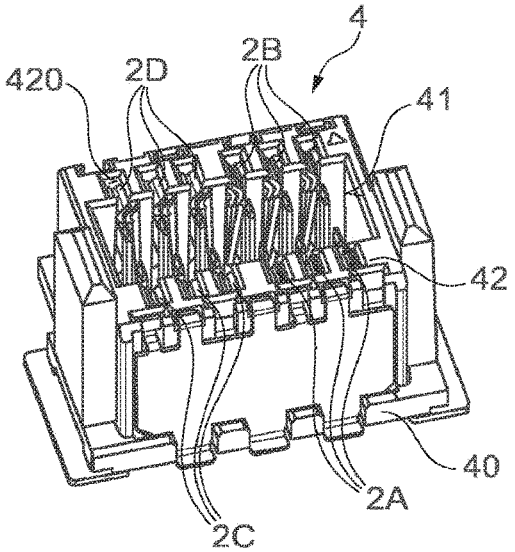
FIG. 4B a view of an associated mating connector part.
Figure 5A:
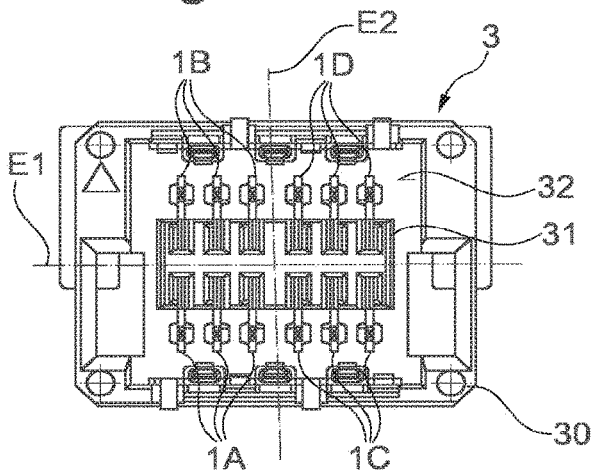
FIG. 5A a front view of the connector part.
Figure 5B:
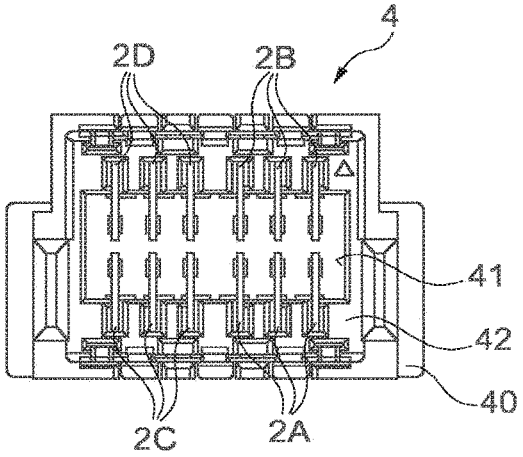
FIG. 5B a front view of the mating connector part.
Figure 6A:
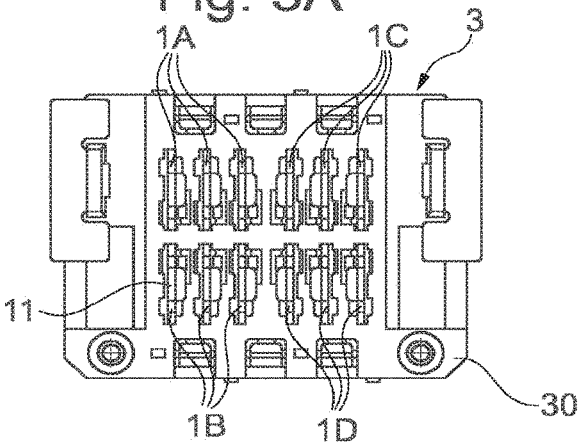
FIG. 6A a rear view of the connector part.
Figure 6B:
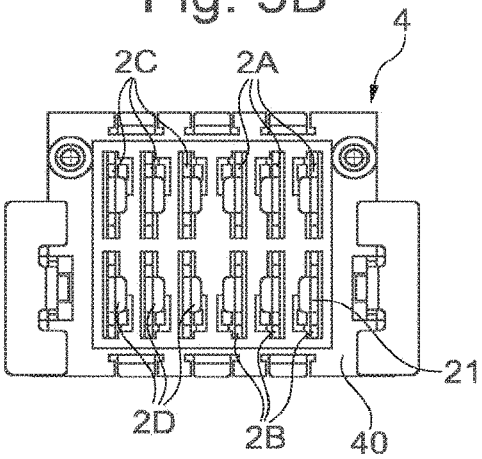
FIG. 6B a rear view of the mating connector part.
Figure 7A:
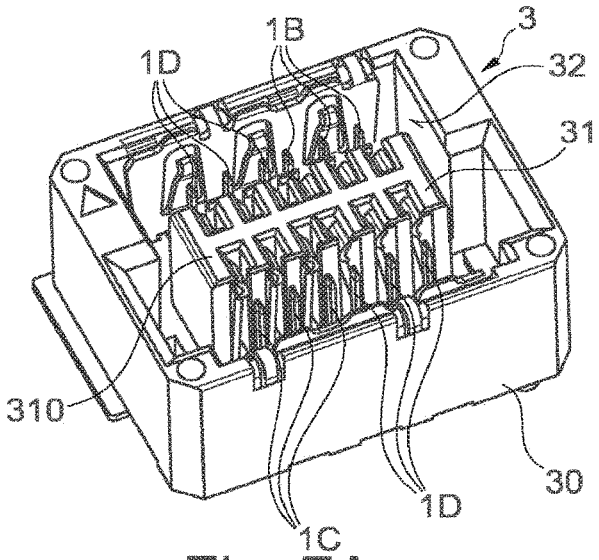
FIG. 7A a view of a connector part having an arrangement of hermaphroditic contact elements according to a further exemplary embodiment.
Figure 7B:
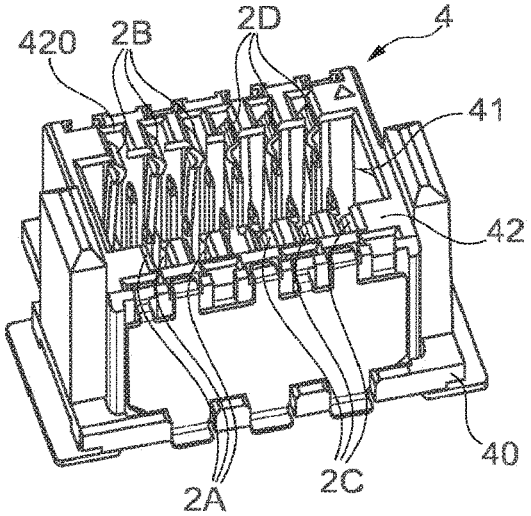
FIG. 7B a view of an associated mating connector part.
Figure 8A:
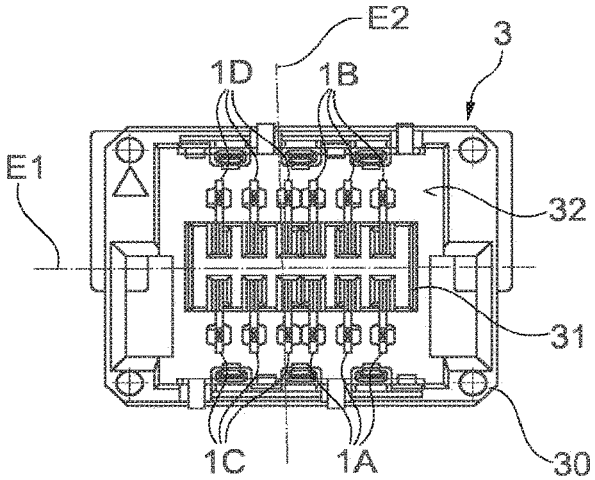
FIG. 8A a front view of the connector part.
Figure 8B:
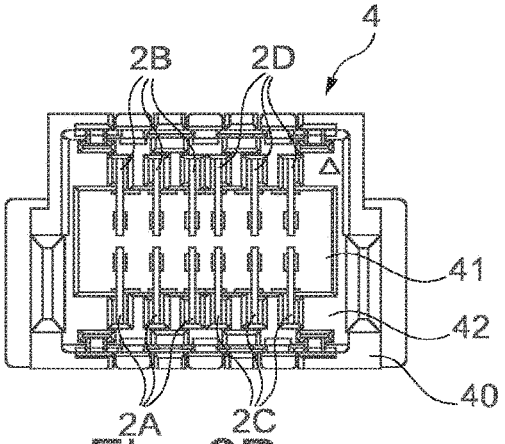
FIG. 8B a front view of the mating connector part.
Figure 9A:
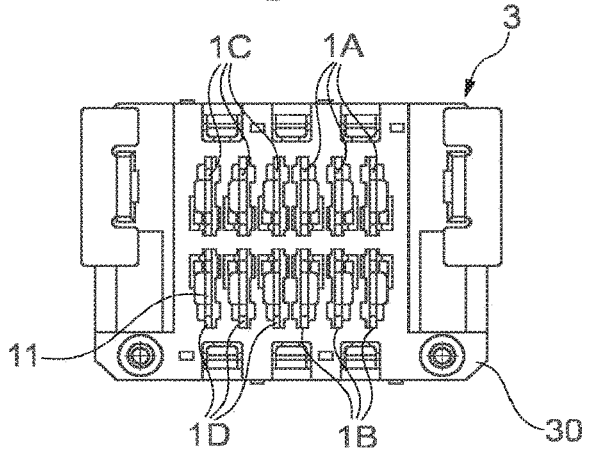
FIG. 9A a rear view of the connector part.
Figure 9B:
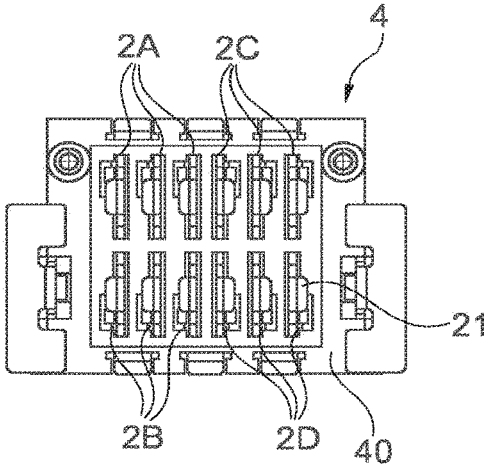
FIG. 9B a rear view of the mating connector part.
Figure 10A:
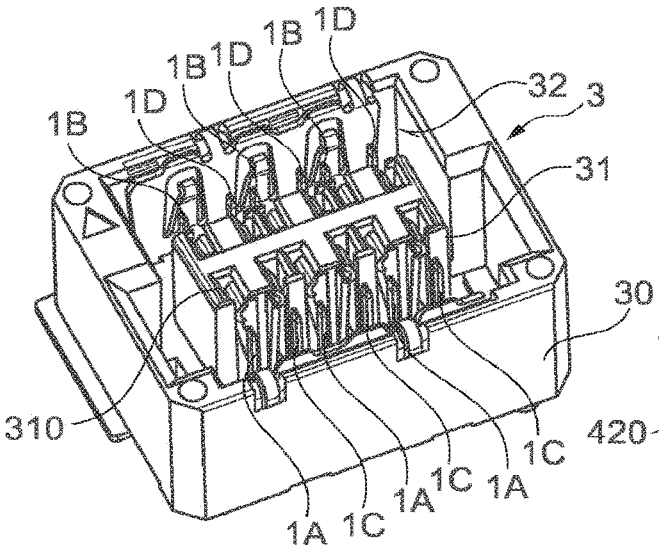
FIG. 10A a view of a connector part having an arrangement of hermaphroditic contact elements according to a further exemplary embodiment.
Figure 10B:
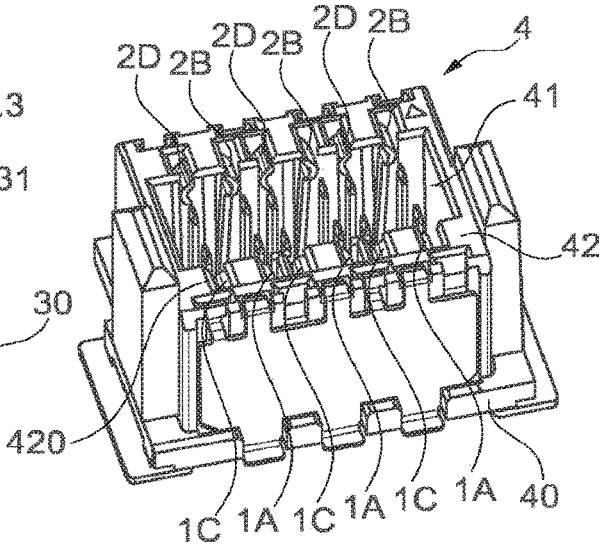
FIG. 10B a view of an associated mating connector part.
Figure 11A:
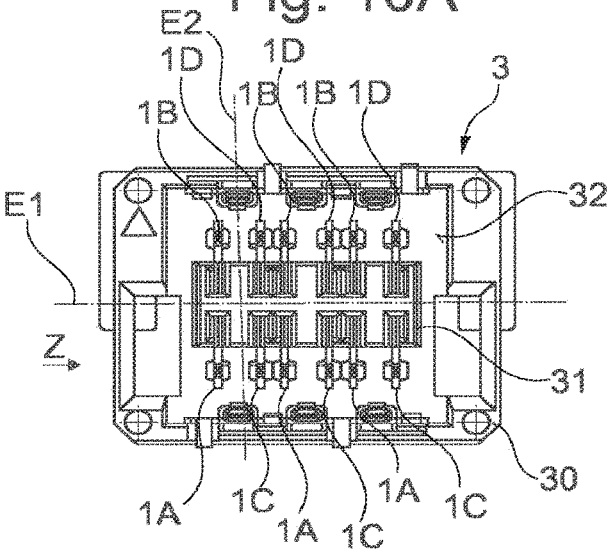
FIG. 11A a front view of the connector part.
Figure 11B:
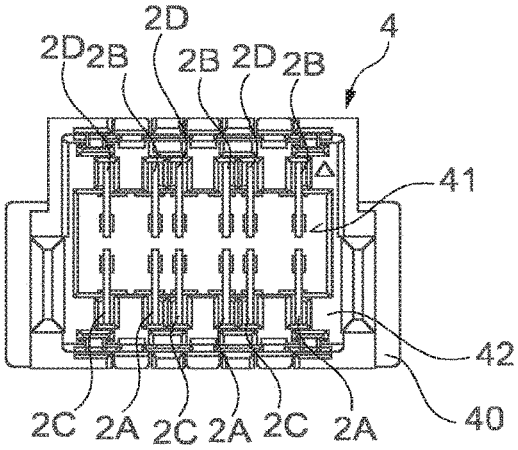
FIG. 11B a front view of the mating connector part.
Figure 12A:
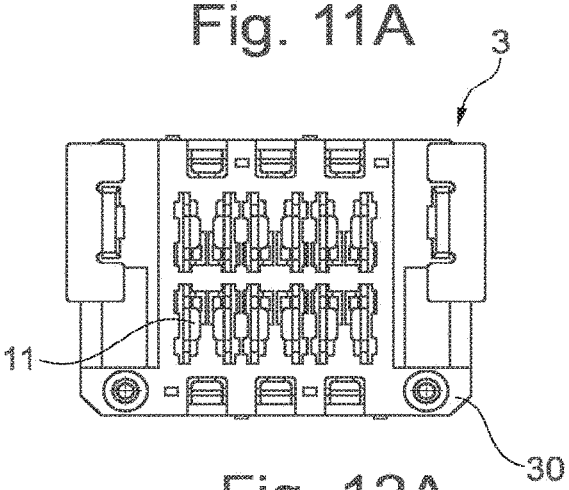
FIG. 12A a rear view of the connector part.
Figure 12B:
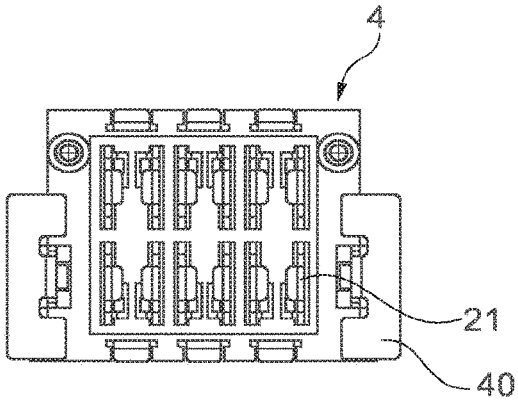
FIG. 12B a rear view of the mating connector part.
Figure 13A:
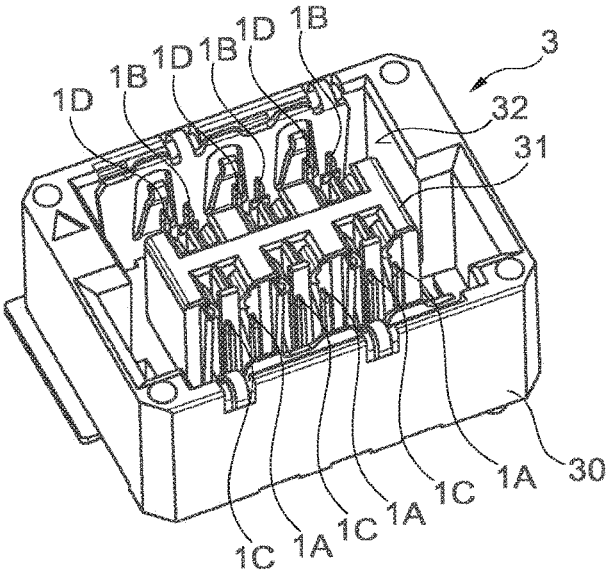
FIG. 13A a view of a connector part having an arrangement of hermaphroditic contact elements according to a further exemplary embodiment.
Figure 13B:
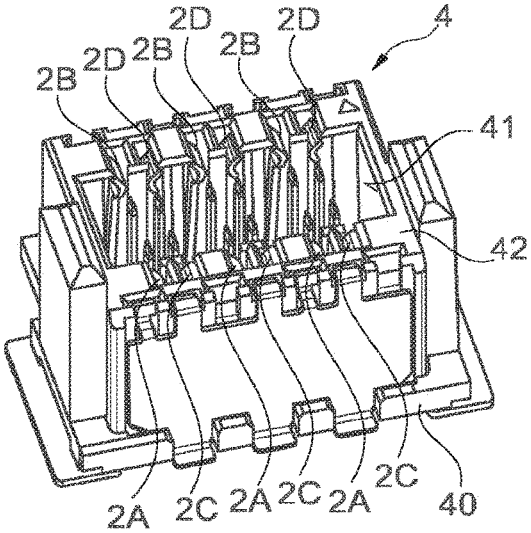
FIG. 13B a view of an associated mating connector part.
Figure 14A:
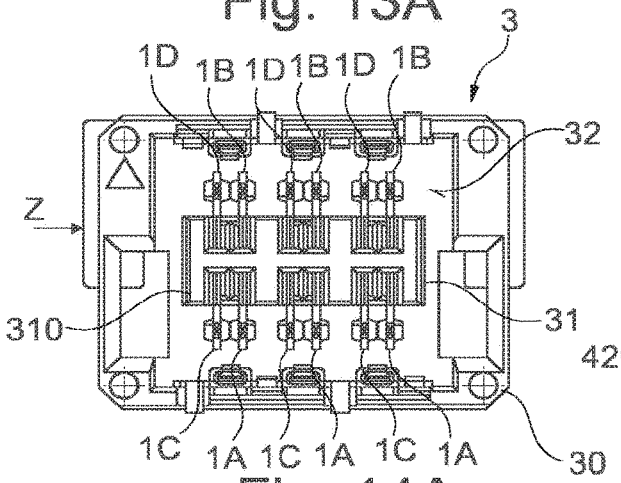
FIG. 14A a front view of the connector part.
Figure 14B:
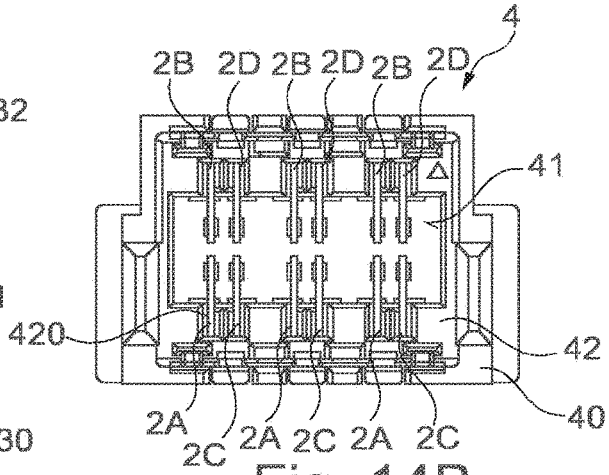
FIG. 14B a front view of the mating connector part.
Figure 15A:
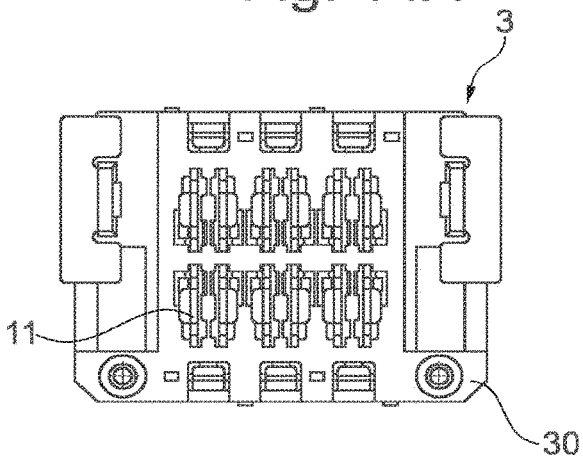
FIG. 15A a rear view of the connector part.
Figure 15B:
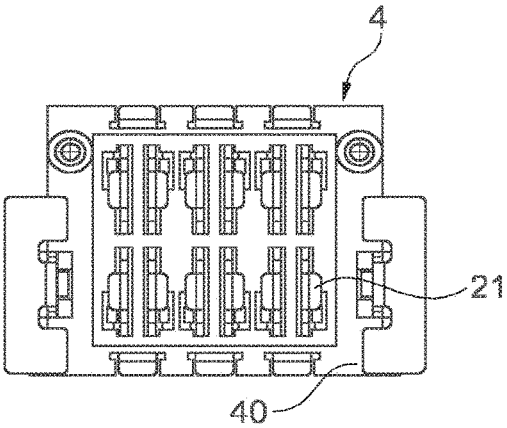
FIG. 15B a rear view of the mating connector part.

As can be seen from the view according to FIG. 3, each hermaphroditic contact element 1A-1D, 2A-2D has a body 10, 20, which extends in a plane spanned by the first direction X and a second direction Y and from which contact lugs 12, 13, 22, 23 protrude along the first direction X. A first contact lug 12, 22 extends in this case along the first direction X in the plane of the body 10, 20, while a second contact lug 13, 23 offset along the second direction Y relatively to the first contact lug 12, 22 is offset relatively to the plane of the body 10, 20 and thus arranged outside the plane.

If associated hermaphroditic contact elements 1A-1D, 2A-2D are connected together in a plugged manner, as shown in FIG. 3, the contact lugs 12, 13, 22, 23 contact along a third direction Z, wherein the contact lugs 12, 13 of the one hermaphroditic contact element 1A-1D abut against the contact lugs 22, 23 of the other hermaphroditic contact element 2A-2D from different sides.

In order to reduce a torque load on connector parts, whose components are the hermaphroditic contact elements 1A-1D, 2A-2D according to FIGS. 1 and 2, the hermaphroditic contact elements 1A-1D, 2A-2D in the arrangements according to FIGS. 1 and 2 are arranged so as to be mirror-inverted to each other to mirror planes E1, E2, with the result that torques M1, M2 about the first direction X and the second direction Y, which act due to the plug-in connection between the hermaphroditic contact elements 1A-1D, 2A-2D, are canceled, and as a result, a balanced arrangement of hermaphroditic contact elements 1A-1D, 2A-2D is provided on each connector part.

The hermaphroditic contact elements 1A-1D are arranged on a first connector part and, in addition, arranged together on a printed circuit board via connection tabs 11 (see FIG. 3) projecting from the bodies 10 of the hermaphroditic contact elements 1A-1D. Likewise, the hermaphroditic contact elements 2A-2D arranged on a second connector part are arranged on a printed circuit board 5 shown schematically in FIG. 1 via connection tabs 21 (see FIG. 3) projecting from the bodies 20 of the hermaphroditic contact elements 2A-2D. Via the connection tabs 11, 21, the hermaphroditic contact elements 1A-1D, 2A-2D can be soldered particularly to terminal surfaces 50 of an associated printed circuit board 5 so that the hermaphroditic contact elements 1A-1D, 2A-2D are mechanically fixed to the associated printed circuit board 5 and electrically contacted by the printed circuit board 5.

In the arrangement of the hermaphroditic contact elements 1A-1D, 2A-2D according to FIG. 1, each hermaphroditic contact element 1A-1D has a hermaphroditic contact element 1A-1D which is mirror-inverted to a first mirror plane E1 and a hermaphroditic contact element 1A-1D which is mirror-inverted to a second mirror plane E2. Thus, the hermaphroditic contact elements 1A, 1C are mirror-inverted to the mirror plane E1 to the hermaphroditic contact elements 1B, 1D in that the arrangement of the contact lugs 12, 13 on the body 10 is reversed when viewed along the second direction Y. In addition, the hermaphroditic contact elements 1A, 1B, the hermaphroditic contact elements 1C, 1D are mirror-inverted to the mirror plane E2 in that the contact lugs 13 protrude from the respective body 10 on different sides.

While in the arrangement according to FIG. 1, the contact lugs 13 of the different hermaphroditic contact elements 1A-1D respectively point outward, the contact lugs 13 of the hermaphroditic contact elements 1A-1D in the arrangement according to FIG. 2 point inward and thus toward one another.

FIGS. 4A, 4B to 6A, 6B show an exemplary embodiment of a connector system with connector parts 3, 4 which can be plugged together to create a connection. Each connector part 3, 4 has a housing 30, 40, on which arrangements of hermaphroditic contact elements 1A-1D, 2A-2D are arranged such that by plugging together, the connector parts 3, 4 can be electrically connected to one another.

The connector part 3 has a plug section 31 which is surrounded by a plug opening 32. Contact openings 310, in which the associated hermaphroditic contact elements 1A-1D rest with their contact lugs 13, are formed on the plug section 31. In contrast, the contact lugs 12 are arranged in the region of the plug opening 32.

The connector part 4 is formed to be complementary to the connector part 3. The connector part 4 thus has a plug opening 41 into which the plug section 31 of the connector part 3 can be inserted. The plug opening 41 is surrounded by a plug section 42 which comes to rest in the plug opening 32 of the connector part 3 when connector parts 3, 4 are connected to one another. Contact openings 420, in which the hermaphroditic contact elements 2A-2D of the connector part 4 with their contact lugs 23 rest, are formed on the plug section 42 while the contact lugs 22 are arranged in the region of the plug opening 41.

In the exemplary embodiment shown, four groups of three hermaphroditic contact elements 1A-1D each are arranged on the connector part 3, which are mirror-inverted with respect to one another about mirror planes E1, E2. The hermaphroditic contact elements 1A, 1C are mirror-inverted to the hermaphroditic contact elements 1B, 1D with respect to the mirror plane E1. In addition, the hermaphroditic contact elements 1A, 1B are mirror-inverted to the hermaphroditic contact elements 1C, 1D with respect to the mirror plane E2. The result is a balanced arrangement of hermaphroditic contact elements 1A-1D on the sides of the connector part 3 and also of the hermaphroditic contact elements 2A-2D on the sides of the connector part 4, due to which a torque load is largely reduced when connector parts 3, 4 are plugged in.

In the exemplary embodiment according to FIGS. 7A, 7B to 9A, 9B, four groups of three hermaphroditic contact elements 1A-1D, 2A-2D each are also formed on each connector part 3, 4, which are mirror-inverted to each other with respect to mirror planes E1, E2. The arrangement of the hermaphroditic contact elements 1A-1D of the connector part 3 and likewise of the hermaphroditic contact elements 2A-2D of the connector part 4 with a view to the mirror plane E2 is, in this case, reverse to the exemplary embodiment according to FIGS. 4A, 4B to 6A, 6B.

In the exemplary embodiment according to FIGS. 10A, 10B to 12A, 12B, three quad groups of hermaphroditic contact elements 1A-1D, 2A-2D are formed on each connector part 3, 4, which are arranged in mirror symmetry with respect to one another and are thus balanced with respect to one another. Thus, in case of the connector part 3, a pair of hermaphroditic contact elements 1C, 1D mirror-inverted to the mirror plane E2 is arranged adjacently to two hermaphroditic contact elements 1A, 1B along the third direction Z. The hermaphroditic contact elements 1B, 1D are mirror-inverted to the hermaphroditic contact elements 1A, 1C with respect to the mirror plane E1. This again results in a balanced arrangement of hermaphroditic contact elements 1A-1D, 2A-2D reduced in the torque load on each connector part 3, 4.

The exemplary embodiment according to FIGS. 13A, 13B to 15A, 15B is reverse in the sequence of the hermaphroditic contact elements 1A-1D, 2A-2D on each connector part 3, 4 when viewed along the third direction Z relatively to the sequence in the exemplary embodiment of FIGS. 10A 10B to 12A, 12B.

Since, in the case of the connector parts 3, 4, for each hermaphroditic contact element 1A-1D, 2A-2D, a hermaphroditic contact element 1A-1D, 2A-2D mirror-inverted to the mirror plane E1 and a hermaphroditic contact element 1A-1D, 2A-2D mirror-inverted to the mirror plane E2 exist, the torques about the first direction X and the second direction Y cancel each other in the arrangements of hermaphroditic contact elements 1A-1D, 2A-2D. As a result, no torques thus have to be absorbed and deflected on the housing 30, 40 of the connector parts 3, 4 in the plugged state.

The idea underlying the invention is not limited to the exemplary embodiments described above but can in principle be realized in a completely different manner.

Thus, other forms of hermaphroditic contact elements than those described here are also conceivable and possible.

Such arrangements of hermaphroditic contact elements may be used on entirely different connector parts in order to produce quite different connections, for example a data link or an electrical supply at an industrial plant or the like.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMBERS

1A-1D Hermaphroditic contact element
10 Body
11 Connection tab
12 Contact lug
13 Contact lug
130 Contact end
131 Connecting section
2A-2D Hermaphroditic contact element
20 Body
21 Connection tab
22 Contact lug
23 Contact lug
230 Contact end
231 Connecting section
3 Connector part
30 Housing
31 Plug section
310 Contact opening
32 Plug opening
4 Connector part
40 Housing
41 Plug opening
42 Plug section
420 Contact opening
5 Printed circuit board
50 Terminal surface
E1, E2 Mirror plane
M1, M2 Torque
X, Y, Z Direction

The invention claimed is:

1. A connector part, comprising:

a plurality of hermaphroditic contact elements configured to contact associated hermaphroditic contact elements of a mating connector part, each of the plurality of hermaphroditic contact elements having a body, a single first contact lug extending from the body along a first direction, and a single second contact lug extending from the body along the first direction, wherein the first contact lug and the second contact lug are offset from each other along a second direction that extends transversely to the first direction, and along a third direction that extends transversely to the first direction and transversely to the second direction, wherein the connector part has, for each hermaphroditic contact element, a hermaphroditic contact element mirror-inverted to a first mirror plane spanned by the first direction and the third direction such that the second contact lug of a first hermaphroditic contact element, which is mirror-inverted to the first mirror plane with a second hermaphroditic contact element, and the second contact lug of the second hermaphroditic contact are closer in distance to each other than the first contact lugs of the first hermaphroditic contact element and the second hermaphroditic contact element, wherein the connector part has, for each hermaphroditic contact element, a hermaphroditic contact element mirror-inverted to a second mirror plane spanned by the first direction and the second direction, and wherein the second contact lug is connected to the body via a connecting section in a region of which a bend is created, so that the second contact lug is offset from the second mirror plane and arranged outside the second mirror plane.

2. The connector part according to claim 1, wherein a number of hermaphroditic contact elements of the connector part corresponds to four or an integer multiple of four.

3. The connector part according to claim 1, wherein the body of each hermaphroditic contact element extends planarly along a plane spanned by the first direction and the second direction.

4. The connector part according to claim 1, wherein the first contact lug extends in a plane of the body.

5. The connector part according to claim 1, wherein the second contact lug is offset from a plane along the third direction.

6. The connector part according to claim 1, wherein the connector part has, for a group of more than one hermaphroditic contact element, a group of hermaphroditic contact elements mirror-inverted to the first mirror plane and a group of hermaphroditic contact elements mirror-inverted to the second mirror plane.

7. The connector part according to claim 1, wherein the hermaphroditic contact elements are connected together to a printed circuit board.

8. The connector part according to claim 1, wherein the body of each hermaphroditic contact element has a connection tab via which the hermaphroditic contact element is connected to the printed circuit board.

9. A connector system, comprising:

the connector part according to claim 1; and a mating connector part having a plurality of hermaphroditic contact elements for plug-in connection with the connector part.

* * * * *